US009547254B2

(12) United States Patent
Kuroda

(10) Patent No.: US 9,547,254 B2
(45) Date of Patent: Jan. 17, 2017

(54) SEMICONDUCTIVE ROLLER

(71) Applicant: SUMITOMO RUBBER INDUSTRIES, LTD., Kobe-shi, Hyogo (JP)

(72) Inventor: Kenichi Kuroda, Kobe (JP)

(73) Assignee: Sumitomo Rubber Industries, Ltd., Kobe-shi (JP)

( * ) Notice: Subject to any disclaimer, the term of this patent is extended or adjusted under 35 U.S.C. 154(b) by 0 days.

(21) Appl. No.: 15/077,231

(22) Filed: Mar. 22, 2016

(65) Prior Publication Data

US 2016/0291505 A1 Oct. 6, 2016

(30) Foreign Application Priority Data

Apr. 6, 2015 (JP) ..... 2015-077939

(51) Int. Cl.
*G03G 15/08* (2006.01)

(52) U.S. Cl.
CPC ..... *G03G 15/0808* (2013.01)

(58) Field of Classification Search
CPC ..... G03G 15/0808
USPC ..... 399/286
See application file for complete search history.

(56) References Cited

U.S. PATENT DOCUMENTS

2002/0114649 A1* 8/2002 Ohuchi ..... G03G 15/0818 399/286
2009/0010684 A1* 1/2009 Satoh ..... G03G 15/0818 399/286

FOREIGN PATENT DOCUMENTS

| | | | |
|---|---|---|---|
| JP | 3601811 | B2 | 12/2004 |
| JP | 2005-148467 | A | 6/2005 |
| JP | 2006-91118 | A | 4/2006 |
| JP | 2007-154165 | A | 6/2007 |
| JP | 5523428 | B2 | 6/2014 |

* cited by examiner

*Primary Examiner* — Hoang Ngo
(74) *Attorney, Agent, or Firm* — Birch, Stewart, Kolasch & Birch

(57) ABSTRACT

A semiconductive roller (1) is provided, which is formed from a rubber composition containing a rubber component including: (1) an epichlorohydrin rubber; (2) at least one solid rubber selected from the group consisting of a solid BR and a solid SBR; and (3) at least one liquid rubber selected from the group consisting of a liquid BR and a liquid SBR.

11 Claims, 1 Drawing Sheet

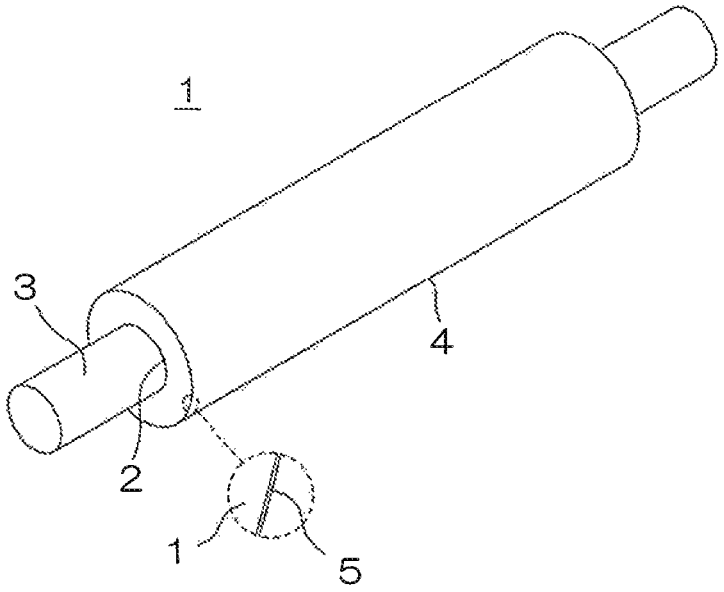
1
3
4
2
1
5

SEMICONDUCTIVE ROLLER

TECHNICAL FIELD

The present invention relates to a semiconductive roller to be advantageously used as a developing roller or the like in an electrophotographic image forming apparatus.

BACKGROUND ART

In an electrophotographic image forming apparatus such as a laser printer, an electrostatic copying machine, a plain paper facsimile machine or a printer-copier-facsimile multifunction machine, an electrostatic latent image formed on a surface of a photoreceptor body by electrically charging the photoreceptor surface and exposing the photoreceptor surface to light is developed into a toner image, and a developing roller is used for the development.

More specifically, toner is electrically charged by rotating the developing roller in contact with an amount regulating blade (charging blade). The electrically charged toner is applied onto an outer peripheral surface of the developing roller, and the toner application amount is regulated by the amount regulating blade. Thus, a toner layer is formed on the outer peripheral surface of the developing roller as having a generally constant thickness.

When the developing roller is further rotated in this state to transport the toner layer to the vicinity of the surface of the photoreceptor body, the toner of the toner layer is selectively transferred from the toner layer to the surface of the photoreceptor body according to the electrostatic latent image formed on the surface of the photoreceptor body. Thus, the electrostatic latent image is developed into the toner image.

With a trend toward the use of a toner including more uniform, more spherical and smaller size toner particles or a polymeric toner, a semiconductive roller having a roller resistance controlled, for example, at not higher than $10^8\Omega$ is effectively used as the developing roller in order to impart the toner with higher chargeability and efficiently develop the electrostatic latent image into the toner image without adhesion of the toner thereto.

Further, the developing roller is required to suppress degradation of the toner and have excellent imaging durability.

The term "imaging durability" is defined as an index that indicates how long the image formation quality can be properly maintained when the same toner is repeatedly used for the image formation.

A very small part of toner contained in a developing section of the image forming apparatus is used in each image forming cycle, and the remaining major part of the toner is repeatedly circulated in the developing section. Since the developing roller is provided in the developing section and repeatedly brought into contact with the toner, whether or not the developing roller can prevent damage to the toner is a key factor to the improvement of the imaging durability.

If the imaging durability is reduced, the formed image is liable to have white streaks in its black solid portion or have fogging in its marginal portion, thereby having a lower image quality.

To cope with this, it is contemplated to add a softening agent such as an oil or a plasticizer, or to use a liquid rubber in combination with other rubber as a rubber component (Patent Documents 1 to 3) to improve the flexibility of the developing roller.

However, the use of the softening agent or the liquid rubber is liable to increase the compression set of the developing roller. The developing roller having a greater compression set is liable to suffer from so-called permanent compressive deformation. That is, when the developing roller is kept in press contact with the photoreceptor body during the stop of the image forming apparatus and then is rotated to be brought out of the press contact, for example, the press contact portion of the developing roller is not restored to its original state. This may result in imaging failure such as uneven image.

Particularly, when the developing roller is incorporated in a developing unit of the image forming apparatus and kept in contact with the surface of the photoreceptor body for a longer period of time in a higher temperature and higher humidity environment, for example, the softening agent is liable to bleed on the developing roller. The bleeding softening agent is liable to contaminate the photoreceptor body to cause imaging failure (e.g., a contamination line occurs in a formed image).

CITATION LIST

[Patent Documents]
Patent Document 1: JP3601811
Patent Document 2: JP2005-148467A
Patent Document 3: JP2007-154165A

SUMMARY OF THE INVENTION

Problem to be Solved by the Invention

It is an object of the present invention to provide a semiconductive roller which is flexible, excellent in imaging durability without degradation of the toner, less liable to contaminate the photoreceptor body and substantially free from the permanent compressive deformation with a reduced compression set particularly when being used as the developing roller.

Solution to Problem

The present invention provides a semiconductive roller formed from a rubber composition which contains a rubber component including:

(1) an epichlorohydrin rubber;

(2) at least one solid rubber selected from the group consisting of a solid butadiene rubber and a solid styrene butadiene rubber; and (3) at least one liquid rubber selected from the group consisting of a liquid butadiene rubber and a liquid styrene butadiene rubber.

Effects of the Invention

According to the present invention, the semiconductive roller is flexible, excellent in imaging durability without the degradation of the toner, less liable to contaminate the photoreceptor body, and substantially free from the permanent compressive deformation with a reduced compression set particularly when being used as the developing roller.

BRIEF DESCRIPTION OF THE DRAWING

The FIGURE is a perspective view illustrating an exemplary semiconductive roller according to one embodiment of the present invention.

EMBODIMENTS OF THE INVENTION

The inventive semiconductive roller is formed from a rubber composition which contains a rubber component including:

(1) an epichlorohydrin rubber;

(2) at least one solid rubber selected from the group consisting of a solid butadiene rubber (BR) and a solid styrene butadiene rubber (SBR); and (3) at least one liquid rubber selected from the group consisting of a liquid butadiene rubber and a liquid styrene butadiene rubber.

As described in Patent Documents 1 to 3, it is already known that a liquid rubber crosslinkable with the other rubbers of the rubber component and hence free from the contamination of the photoreceptor body is blended in the rubber composition for the semiconductive roller.

However, the inventor of the present invention found that, if the combination of the liquid rubber and the other rubbers is improper, the compatibility of the liquid rubber with the other rubbers will be insufficient. Problematically, a semiconductive roller produced from the resulting rubber composition is liable to have a linear mark, or liable to suffer from the permanent compressive deformation with an increased compression set when being used as the developing roller as described above. Conversely, the semiconductive roller is liable to have lower imaging durability with an excessively high hardness.

According to the present invention, in contrast, the epichlorohydrin rubber (1) for imparting the semiconductive roller with ion conductivity, the solid BR and/or the solid SBR (2) as the solid rubber for forming the overall shape of the semiconductive roller, and the liquid BR and/or the liquid SBR (3) as the liquid rubber are selectively used in combination for the rubber component of the rubber composition. Thus, the semiconductive roller formed from the rubber composition is flexible, excellent in imaging durability without the degradation of the toner, less liable to contaminate the photoreceptor body, and substantially free from the permanent compressive deformation with a reduced compression set particularly when being used as the developing roller.

<<Rubber Composition>>

At least the aforementioned three types of rubbers are used in combination for the rubber component of the rubber composition.

<(1) Epichlorohydrin Rubber>

Examples of the epichlorohydrin rubber (1) include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the roller resistance of the semiconductive roller. If the ethylene oxide content is less than the aforementioned range, however, it will be impossible to sufficiently provide this function and hence to sufficiently reduce the roller resistance of the semiconductive roller.

If the ethylene oxide content is greater than the aforementioned range, on the other hand, ethylene oxide is liable to be crystallized, whereby the segment motion of molecular chains is hindered to adversely increase the roller resistance of the semiconductive roller. In addition, the semiconductive roller is liable to have a higher hardness after the crosslinking and, hence, lower imaging durability. Further, the rubber composition is liable to have a higher viscosity and, hence, poorer processability when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller. However, if the allyl glycidyl ether content is less than the aforementioned range, it will be impossible to provide this function and hence to sufficiently reduce the roller resistance of the semiconductive roller.

Allyl glycidyl ether also functions as crosslinking sites during the crosslinking of the GECO. Therefore, if the allyl glycidyl ether content is greater than the aforementioned range, the crosslinking density of the GECO is increased, whereby the segment motion of molecular chains is hindered to adversely increase the roller resistance of the semiconductive roller. Further, this may reduce the tensile strength, the fatigue characteristic properties and the flexure resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

<(2) Solid BR and/or Solid SBR>

(Solid BR)

Usable as the solid BR are various crosslinkable BRs which are solid at a room temperature before the crosslinking.

Particularly, a higher cis-content BR having a cis-1,4 bond content of not less than 95% and having excellent lower-temperature characteristic properties and a lower hardness and hence higher flexibility in a lower-temperature and lower-humidity environment is preferred.

The BRs include those of an oil-extension type having flexibility controlled by addition of an extension oil, and those of a non-oil-extension type containing no extension oil. Where the semiconductive roller is used as the developing roller, a solid BR of the non-oil-extension type is preferably used for prevention of the contamination of the photoreceptor body.

Specific examples of the solid BR include Nipol (registered trade name) BR1220 and BR1250H available from Nippon Zeon Corporation, JSR (registered trade name) BR01, JSR T700, JSR BR51 and JSR BR730 available from JSR Co., Ltd., and DIENE (registered trade name) NF35R available from Asahi Kasei Chemicals Corporation.

These solid BRs may be used alone or in combination.

(Solid SBR)

Usable as the solid SBR are various crosslinkable SBRs which are synthesized by copolymerizing styrene and 1,3-butadiene by an emulsion polymerization method, a solution polymerization method and other various polymerization methods and are solid at a room temperature before the crosslinking.

According to the styrene content, the SBRs are classified into a higher styrene content type, an intermediate styrene content type and a lower styrene content type, and any of these types of SBRs is usable.

The SBRs include those of an oil-extension type having flexibility controlled by addition of an extension oil, and those of a non-oil-extension type containing no extension oil. Where the semiconductive roller is used as the developing roller, a solid SBR of the non-oil-extension type is preferably used for prevention of the contamination of the photoreceptor body.

Specific examples of the solid SBR of the non-oil-extension type synthesized by the emulsion polymerization method (E-SBR) include JSR 1500, JSR 1502, JSR 1503, JSR 1507 and JSR 0202 available from JSR Co., Ltd., and Nipol 1500 and Nipol 1502 available from Nippon Zeon Corporation.

Specific examples of the solid SBR of the non-oil-extension type synthesized by the solution polymerization method (S-SBR) include JSR SL552 and JSR SL563 available from JSR Co., Ltd., and Nipol NS116R, Nipol NS612, Nipol NS616 and Nipol NS310S available from Nippon Zeon Corporation.

These solid SBRs may be used alone or in combination.

<(3) Liquid BR and/or Liquid SBR>

(Liquid BR)

Usable as the liquid BR are various crosslinkable liquid BRs which are liquid at a room temperature before the crosslinking.

Specific examples of the liquid BRs include KURAPRENE (registered trade name) LBR-300, LBR-305, LBR-307 and LBR-352 available from Kuraray Co., Ltd., which may be used alone or in combination.

The liquid BR to be used in combination with the solid BR preferably has a number average molecular weight Mn of not less than 7500 and not greater than 10000, particularly preferably not less than 8500 and not greater than 9500 in order to reduce the compression set of the semiconductive roller after the crosslinking for suppression of the permanent compressive deformation and to impart the semiconductive roller with proper flexibility for improvement of the imaging durability. The liquid BR to be used in combination with the solid SBR preferably has a number average molecular weight Mn of not less than 7500 and not greater than 10000, particularly preferably not greater than 8500.

(Liquid SBR)

Usable as the liquid SBR are various crosslinkable liquid SBRs which are liquid at a room temperature before the crosslinking.

Specific examples of the liquid SBR include KURAPRENE L-SBR-820 and L-SBR-841 available from Kuraray Co., Ltd.

Like the liquid BR, the liquid SBR preferably has a number average molecular weight Mn of not less than 8000 and not greater than 10000, particularly preferably not greater than 9000.

<(4) Chloroprene>

A chloroprene (CR) may be blended with the three types of rubbers (1) to (3) for the rubber component.

The CR functions to further improve the flexibility and the imaging durability of the semiconductive roller. Further, the roller resistance of the semiconductive roller can be finely controlled by blending the CR.

The CR is generally synthesized by emulsion polymerization of chloroprene, and may be classified in a sulfur modification type or a non-sulfur-modification type depending on the type of a molecular weight adjusting agent to be used for the emulsion polymerization. In the present invention, any of these types of CRs are usable.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR may be classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent. The xanthogen modification type CR is synthesized in substantially the same manner as the sulfur modification type CR, except that an alkyl xanthogen compound is used as the molecular weight adjusting agent.

Further, the CR may be classified in a lower crystallization speed type, an intermediate crystallization speed type or a higher crystallization speed type depending on the crystallization speed.

In the present invention, any of the aforementioned types of CRs may be used. Particularly, CRs of the non-sulfur-modification type and the lower crystallization speed type are preferably used alone or in combination.

Further, a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used alone or in combination.

A specific example of the CR is SHOPRENE (registered trade name) WRT available from Showa Denko K. K.

<Proportions of Rubbers for Rubber Component>

The proportion of the epichlorohydrin rubber (1) is preferably not less than 10 parts by mass and not greater than 30 parts by mass, particularly preferably not less than 15 parts by mass and not greater than 25 parts by mass, based on 100 parts by mass of the total amount of the three rubbers (1) to (3) or the four rubbers (1) to (4).

If the proportion of the epichlorohydrin rubber is less than the aforementioned range, the semiconductive roller is liable to have an increased roller resistance and, therefore, suffer from reduction in toner charge amount and toner transport amount when being used as the developing roller.

If the proportion of the epichlorohydrin rubber is greater than the aforementioned range, on the other hand, the semiconductive roller is liable to suffer from the adhesion of the toner and reduction in formed image density.

The proportion of the solid BR and/or the solid SBR is a balance calculated based on the amounts of the three rubbers (1) to (3) and the four rubbers (1) to (4). That is, where the proportions of the epichlorohydrin rubber (1), the liquid rubber (3) and the CR (4) are predetermined, the proportion of the solid BR and/or the solid SBR (2) is determined so that the total amount of the rubbers (1) to (3) or the rubbers (1) to (4) is 100 parts by mass.

The proportion of the liquid rubber (3) is properly determined depending on the type of the liquid rubber (3) to be used and the type of the solid rubber (2) to be used in combination with the liquid rubber (3).

That is, where the solid rubber (2) is the solid BR and the liquid rubber (3) is the liquid BR, the proportion of the liquid BR is preferably not less than 3 parts by mass and not greater than 40 parts by mass, particularly preferably not less than 5 parts by mass, based on 100 parts by mass of the overall rubber component.

Where the solid rubber (2) is the solid BR and the liquid rubber (3) is the liquid SBR, the proportion of the liquid SBR is preferably not less than 3 parts by mass and not greater than 40 parts by mass, particularly preferably not less than 5 parts by mass, based on 100 parts by mass of the overall rubber component.

Where the solid rubber (2) is the solid SBR and the liquid rubber (3) is the liquid BR, the proportion of the liquid BR is preferably not less than 3 parts by mass and not greater than 30 parts by mass, particularly preferably not less than 5 parts by mass, based on 100 parts by mass of the overall rubber component.

Where the solid rubber (2) is the solid SBR and the liquid rubber (3) is the liquid SBR, the proportion of the liquid SBR is preferably not less than 5 parts by mass and not greater than 40 parts by mass, particularly preferably not less than 10 parts by mass, based on 100 parts by mass of the overall rubber component.

If the proportion of the liquid rubber is less than the aforementioned range in any of the aforementioned combinations, it will be impossible to provide the effect of the blending of the liquid rubber. Therefore, the semiconductive roller is liable to have lower imaging durability with an excessively high hardness when being used as the developing roller.

If the proportion of the liquid rubber is greater than the aforementioned range, the semiconductive rubber is liable to be excessively flexible with an excessively great amount of the liquid rubber and, hence, suffer from the permanent compressive deformation with a reduced compression set.

The proportion of the CR is preferably not less than 1 part by mass and not greater than 30 parts by mass, particularly preferably not less than 5 parts by mass and not greater than 20 parts by mass, based on 100 parts by mass of the overall rubber component.

If the proportion of the CR is less than the aforementioned range, it will be impossible to sufficiently provide the effect of the blending of the CR.

If the proportion of the CR is greater than the aforementioned range, on the other hand, the proportion of the epichlorohydrin rubber is relatively reduced. Therefore, the semiconductive rubber is liable to have a higher roller resistance and suffer from reduction in toner charge amount and toner transport amount when being used as the developing roller.

The CR is not necessarily required to be blended.

<Crosslinking Component>

The rubber composition contains a crosslinking component for crosslinking the rubber component. The crosslinking component includes a crosslinking agent, an accelerating agent and the like.

Examples of the crosslinking agent include a sulfur crosslinking agent, a thiourea crosslinking agent, a triazine crosslinking agent, a peroxide crosslinking agent and monomers, which may be used alone or in combination according to the type of the rubber component.

Particularly, the sulfur crosslinking agent is preferred.

Examples of the sulfur crosslinking agent include sulfur such as sulfur powder and organic sulfur-containing compounds such as tetramethylthiuram disulfide and N,N-dithiobismorpholine, which may be used alone or in combination. Particularly, the sulfur is preferred.

The proportion of the sulfur to be blended is preferably not less than 0.2 parts by mass and not greater than 3 parts by mass, particularly preferably not less than 0.4 parts by mass and not greater than 2 parts by mass, based on 100 parts by mass of the overall rubber component.

Examples of the accelerating agent include inorganic accelerating agents such as lime, magnesia (MgO) and litharge (PbO), and organic accelerating agents, which may be used alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide, tetrabutylthiuram disulfide and dipentamethylenethiuram tetrasulfide; and thiourea accelerating agents such as ethylene thiourea, which may be used alone or in combination.

Different types of accelerating agents have different functions and, therefore, are preferably used in combination.

The proportion of each of the accelerating agents to be blended may be properly determined depending on the type of the accelerating agent, but is typically not less than 0.1 part by mass and not greater than 5 parts by mass, particularly preferably not less than 0.2 parts by mass and not greater than 2 parts by mass, based on 100 parts by mass of the overall rubber component.

<Other Ingredients>

As required, various additives may be added to the rubber composition. Examples of the additives include a crosslinking assisting agent, an acid-accepting agent, a filler, an anti-aging agent, an anti-oxidant, an anti-scorching agent, a co-crosslinking agent, a pigment, a flame retarder and a defoaming agent.

Examples of the crosslinking assisting agent include: metal compounds such as zinc white (zinc oxide); fatty acids such as stearic acid, oleic acid and cotton seed fatty acids; and other conventionally known crosslinking assisting agents, which may be used alone or in combination.

The proportion of each of the crosslinking assisting agents to be blended is preferably not less than 0.1 part by mass and not greater than 7 parts by mass, particularly preferably not less than 0.5 parts by mass and not greater than 5 parts by mass, based on 100 parts by mass of the overall rubber component.

In the presence of the acid accepting agent, chlorine-containing gases generated from the epichlorohydrin rubber and the CR during the crosslinking of the rubber component are prevented from remaining in the semiconductive roller.

Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 0.5 parts by mass and not greater than 6 parts by mass, particularly preferably not less than 1 part by mass and not greater than 4 parts by mass, based on 100 parts by mass of the overall rubber component.

Examples of the filler include zinc oxide, silica, carbon, carbon black, clay, talc, calcium carbonate, magnesium carbonate and aluminum hydroxide, which may be used alone or in combination.

The blending of the filler improves the mechanical strength and the like of the semiconductive roller.

The proportion of the filler to be blended is preferably not less than 5 parts by mass and not greater than 25 parts by mass, particularly preferably not greater than 20 parts by mass, based on 100 parts by mass of the overall rubber component.

An electrically conductive filler such as electrically conductive carbon black may be blended as the filler to impart the semiconductive roller with electron conductivity.

An example of the electrically conductive carbon black include DENKA BLACK (registered trade name) available from Denki Kagaku Kogyo K.K.

The proportion of the electrically conductive carbon black to be blended is preferably not less than 10 parts by mass and not greater than 30 parts by mass, particularly preferably not less than 15 parts by mass and not greater than 25 parts by mass, based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used alone or in combination.

Examples of the ethylenically unsaturated monomers include:

(a) monocarboxylic acids such as acrylic acid, methacrylic acid and crotonic acid;

(b) dicarboxylic acids such as maleic acid, fumaric acid and itaconic acid;

(c) esters and anhydrides of the unsaturated carboxylic acids (a) and (b);

(d) metal salts of the monomers (a) to (c);

(e) aliphatic conjugated dienes such as 1,3-butadiene, isoprene and 2-chloro-1,3-butadiene;

(f) aromatic vinyl compounds such as styrene, α-methylstyrene, vinyltoluene, ethylvinylbenzene and divinylbenzene;

(g) vinyl compounds such as triallyl isocyanurate, triallyl cyanurate and vinylpyridine each having a hetero ring; and (h) cyanovinyl compounds such as (meth)acrylonitrile and α-chloroacrylonitrile, acrolein, formyl sterol, vinyl methyl ketone, vinyl ethyl ketone and vinyl butyl ketone. These ethylenically unsaturated monomers may be used alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth) acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used alone or in combination.

The rubber composition containing the ingredients described above can be prepared in a conventional manner. First, the rubbers for the rubber component are blended in the predetermined proportions, and the resulting rubber component is simply kneaded. After additives other than the crosslinking component are added to and kneaded with the rubber component, the crosslinking component is finally added to and further kneaded with the resulting mixture. Thus, the rubber composition is provided. A kneader, a Banbury mixer, an extruder or the like, for example, is usable for the kneading.

<<Semiconductive Roller>>

The FIGURE is a perspective view illustrating an exemplary semiconductive roller according to one embodiment of the present invention.

Referring to the FIGURE, the semiconductive roller 1 according to this embodiment includes a tubular body formed from the aforementioned rubber composition and having a nonporous single-layer structure, and a is inserted through a center through-hole 2 of the tubular body and fixed to the through-hole 2.

The shaft 3 is made of a metal such as aluminum, an aluminum alloy or a stainless steel.

The shaft 3 is electrically connected to and mechanically fixed to the semiconductive roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the semiconductive roller 1. Thus, the shaft 3 and the semiconductive roller 1 are unitarily rotatable.

The semiconductive roller 1 may have an oxide film 5 provided in an outer peripheral surface 4 thereof as shown in the FIGURE on an enlarged scale.

The oxide film 5 thus provided functions as a dielectric layer to reduce the dielectric dissipation factor of the semiconductive roller 1. Further, the oxide film serves as a lower friction layer to suppress the adhesion of the toner when the semiconductive roller 1 is used as the developing roller.

In addition, the oxide film 5 can be easily formed, for example, by irradiation with ultraviolet radiation in an oxidizing atmosphere, thereby suppressing the reduction in the productivity of the semiconductive roller 1 and the increase in production costs. However, the oxide film 5 may be obviated.

For the production of the semiconductive roller 1, the rubber composition preliminarily prepared is first extruded into a tubular body by means of an extruder. Then, the tubular body is cut to a predetermined length, and heated in a vulcanization can to crosslink the rubber component.

In turn, the tubular body thus crosslinked is heated in an oven or the like for secondary crosslinking, then cooled, and polished to a predetermined outer diameter.

Various polishing methods such as dry traverse polishing method may be used for the polishing. Where the outer peripheral surface 4 of the semiconductive roller 1 is mirror-polished at the end of the polishing step, the releasability of the outer peripheral surface 4 is improved. Where the semiconductive roller 1 having the mirror-polished outer peripheral surface 4 is used as the developing roller, for example, the adhesion of the toner can be suppressed. In addition, the contamination of the photoreceptor body can be further effectively prevented.

Where the oxide film 5 is formed after the mirror-polishing of the outer peripheral surface 4, as described above, the synergistic effect of the mirror-polishing and the oxide film further advantageously suppresses the adhesion of the toner, and further advantageously prevents the contamination of the photoreceptor body.

The shaft 3 may be inserted into and fixed to the through-hole 2 at any time between the end of the cutting of the tubular body and the end of the polishing.

However, the tubular body is preferably secondarily crosslinked and polished with the shaft 3 inserted through the through-hole 2 after the cutting. This prevents warpage and deformation of the semiconductive roller 1 which may otherwise occur due to expansion and contraction of the tubular body in the secondary crosslinking. Further, the tubular body may be polished while being rotated about the shaft 3. This improves the working efficiency in the polishing, and suppresses deflection of the outer peripheral surface 4.

As previously described, the shaft 3 may be inserted through the through-hole 2 of the tubular body with the intervention of an electrically conductive adhesive agent (particularly a thermosetting adhesive agent) before the secondary crosslinking, or the shaft 3 having an outer diameter greater than the inner diameter of the through-hole 2 may be press-inserted into the through-hole 2.

In the former case, the thermosetting adhesive agent is cured when the tubular body is secondarily crosslinked by the heating in the oven. Thus, the shaft 3 is electrically connected to and mechanically fixed to the semiconductive roller 1.

In the latter case, the electrical connection and the mechanical fixing are achieved simultaneously with the press insertion.

As required, the outer peripheral surface 4 is thereafter oxidized in the aforementioned manner, whereby the oxide film 5 is formed in the outer peripheral surface 4. Thus, the inventive semiconductive roller 1 is completed.

The inventive semiconductive roller 1 may have a double-layer structure which includes an outer layer provided on the side of the outer peripheral surface 4 and an inner layer provided on the side of the shaft 3. Further, the semiconductive roller 1 may have a porous structure.

However, the semiconductive roller 1 preferably has a nonporous single-layer structure for simplification of the structure for production of the semiconductive roller at lower costs with higher productivity and for improvement of the durability and the compression set characteristics thereof.

The term "single-layer structure" herein means that the roller includes a single layer formed from the rubber composition and the oxide film formed by the oxidation process is not counted.

The inventive semiconductive roller 1 can be advantageously used not only as the developing roller but also as a charging roller, a transfer roller, a cleaning roller or the like, for example, in an electrophotographic image forming apparatus such as a laser printer, an electrostatic copying machine, a plain paper facsimile machine or a printer-copier-facsimile multifunction machine.

EXAMPLES

Solid BR-Liquid BR Based Rubber Composition

Example 1-1

Preparation of Rubber Composition

The following rubbers were blended for preparation of a rubber component:

(1) 20 parts by mass of a GECO (EPION (registered trade name) 301 available from Daiso Co., Ltd., and having a molar ratio of EO/EP/AGE=73/23/4);

(2) 69 parts by mass of a solid BR (JSRBR01 available from JSR Co., Ltd., and having a cis-1,4 bond content of 95%);

(3) 1 part by mass of a liquid BR (KURAPRENE LBR-307 available from Kuraray Co., Ltd., and having a number average molecular weight Mn of 8000); and (4) 10 parts by mass of a CR (SHOPRENE WRT available from Showa Denko K. K.)

While 100 parts by mass of the rubber component including the rubbers (1) to (4) was simply kneaded by means of a Banbury mixer, 20 parts by mass of an electrically conductive carbon black (a granular product of DENKA BLACK (registered trade name) available from Denki Kagaku Kogyo K.K.) and 5 parts by mass of zinc white (Zinc Oxide Type-2 available from Mitsui Mining & Smelting Co., Ltd.) as a crosslinking assisting agent were added to the rubber component, and then the resulting mixture was further kneaded.

While the mixture was continuously kneaded, the following crosslinking component was added to the mixture, which was in turn further kneaded. Thus, a rubber composition was prepared.

TABLE 1

| Crosslinking component | Parts by mass |
|---|---|
| Crosslinking agent | 1.05 |
| Accelerating agent TS | 0.50 |
| Accelerating agent DM | 1.50 |
| Accelerating agent 22 | 0.33 |
| Accelerating agent DT | 0.28 |

The ingredients shown in Table 1 are as follows. The amounts (parts by mass) shown in Table 1 are based on 100 parts by mass of the overall rubber component. Crosslinking agent: 5% Oil-containing sulfur (available from Tsurumi Chemical Industry Co., Ltd.) Accelerating agent TS: Tetramethylthiuram monosulfide (SANCELER (registered trade name) TS available from Sanshin Chemical Industry Co., Ltd.) Accelerating agent DM: Di-2-benzothiazolyl disulfide (ACCEL (registered trade name) DM available from Kawaguchi Chemical Industry Co., Ltd.) Accelerating agent 22: Ethylene thiourea (2-mercaptoimidazoline) ACCEL 22-S available from Kawaguchi Chemical Industry Co., Ltd. Accelerating agent DT: 1,3-di-o-tolylguanidine (SANCELER DT available from Sanshin Chemical Industry Co., Ltd.)

(Production of Semiconductive Roller)

The rubber composition thus prepared was fed into an extruder, and extruded into a cylindrical tubular body having an outer diameter of 20 mm and an inner diameter of 7 mm. Then, the tubular body was fitted around a crosslinking shaft, and crosslinked in a vulcanization can at 160° C. for 1 hour.

Then, the crosslinked tubular body was removed from the crosslinking shaft, then fitted around a metal shaft having an outer diameter of 7.5 mm and an outer peripheral surface to which an electrically conductive thermosetting adhesive agent was applied, and heated to 160° C. in an oven. Thus, the tubular body was bonded to the shaft. In turn, opposite end portions of the tubular body were cut.

Then, the ends of the resulting tubular body were properly shaped. Further, the outer peripheral surface of the tubular body was polished by a traverse polishing method by means of a cylindrical polishing machine, and then mirror-polished with a #2000 film (available from Sankyo Rikagaku Co., Ltd.) Thus, a semiconductive roller having an outer diameter of 20.00 mm (with a tolerance of 0.05) was produced.

Examples 1-2 to 1-8

Rubber compositions were prepared in substantially the same manner as in Example 1-1, except that the liquid BR (3) was blended in proportions of 3 parts by mass (Example 1-2), 5 parts by mass (Example 1-3), 10 parts by mass (Example 1-4), 20 parts by mass (Example 1-5), 30 parts by mass (Example 1-6), 40 parts by mass (Example 1-7) and 50 parts by mass (Example 1-8), and the proportion of the solid BR (2) was adjusted so that the total amount of the rubbers for the rubber component was 100 parts by mass. Then, semiconductive rollers were produced in substantially the same manner as in Example 1-1 by using the rubber compositions thus prepared.

Examples 1-9 to 1-15

Rubber compositions were prepared in substantially the same manner as in Example 1-1, except that KURAPRENE LBR-305 (having a number average molecular weight Mn of 26000) was used as the liquid BR (3) in proportions of 1 part by mass (Example 1-9), 5 parts by mass (Example 1-10), 10 parts by mass (Example 1-11), 20 parts by mass (Example 1-12), 30 parts by mass (Example 1-13), 40 parts by mass (Example 1-14) and 50 parts by mass (Example 1-15), and the proportion of the solid BR (2) was adjusted so that the total amount of the rubbers for the rubber component was 100 parts by mass. Then, semiconductive rollers were produced in substantially the same manner as in Example 1-1 by using the rubber compositions thus prepared.

Examples 1-16 to 1-23

Rubber compositions were prepared in substantially the same manner as in Example 1-1, except that KURAPRENE LBR-352 (having a number average molecular weight Mn of 9000) was used as the liquid BR (3) in proportions of 1 part by mass (Example 1-16), 3 parts by mass (Example 1-17), 5 parts by mass (Example 1-18), 10 parts by mass (Example 1-19), 20 parts by mass (Example 1-20), 30 parts by mass (Example 1-21), 40 parts by mass (Example 1-22) and 50 parts by mass (Example 1-23), and the proportion of the solid BR (2) was adjusted so that the total amount of the rubbers for the rubber component was 100 parts by mass. Then, semiconductive rollers were produced in substantially the same manner as in Example 1-1 by using the rubber compositions thus prepared.

Conventional Example 1

A rubber composition was prepared in substantially the same manner as in Example 1-1, except that the liquid BR (3) was not blended and the proportion of the solid BR (2) was 70 parts by mass. Then, a semiconductive roller was produced in substantially the same manner as in Example 1-1 by using the rubber composition thus prepared.

Conventional Example 2

A rubber composition was prepared in substantially the same manner as in Example 1-11, except that 60 parts by mass of an NBR (JSR N250SL available from JSR Co., Ltd., and having a nitrile content of 19.5%) was used instead of the solid BR (2). Then, a semiconductive roller was produced in substantially the same manner as in Example 1-11 by using the rubber composition thus prepared. However, the rubbers for the rubber component had insufficient compatibility, so that the produced semiconductive roller had a longitudinally extending linear mark. Therefore, the following tests were not performed on the semiconductive roller.

<Measurement of Type-A Durometer Hardness>

The Type-A durometer hardness of each of the semiconductive rollers produced in Examples 1-1 to 1-23 and Conventional Example 1 was measured at a standard test temperature of 23±2° C. at a standard test relative humidity of 55±2% (hereinafter sometimes referred to as "standard test environment") by the following measurement method.

In the standard test environment, opposite end portions of a shaft projecting from opposite ends of the semiconductive roller were fixed to a support base. In this state, an indenter point of a Type-A durometer conforming to Japanese Industrial Standards JIS K6253-3:2012 was pressed against a widthwise middle portion of the semiconductive roller from above, and the type-A durometer hardness of the semiconductive roller was measured with a mass load of 1 kg applied to the press surface for a measurement period of 3 seconds (standard measurement period for vulcanized rubber).

It is considered that the semiconductive roller becomes less susceptible to the permanent compressive deformation as the type-A durometer hardness is increased.

<Imaging Durability Test>

The semiconductive rollers produced in Examples 1-1 to 1-23 and Conventional Example 1 were each incorporated in a new cartridge (integrally incorporating a toner container containing a toner, a photoreceptor body, and a developing roller kept in contact with the photoreceptor body) instead of the original developing roller for a commercially available laser printer. The laser printer utilized a positively-chargeable nonmagnetic single-component toner, and had a printing sheet number of about 8000 recommended for the toner.

The new cartridge was mounted in the laser printer in an initial state, and a 5% density image was formed in a higher-temperature and higher-humidity environment at a temperature of 30±1° C. at a relative humidity of 80±1%. Then, the semiconductive roller was evaluated for imaging durability based on the following criteria associated with the fogging.

◎: Excellent imaging durability without fogging.

○: Good imaging durability with slight fogging visually unperceivable.

Δ: Practically acceptable imaging durability with slight fogging in a marginal portion of a paper sheet.

x: Unacceptable imaging durability with fogging in a marginal portion of a paper sheet.

The results are shown in Tables 2 to 7.

TABLE 2

| | Conventional Example 1 | Example 1-1 | Example 1-2 | Example 1-3 | Example 1-4 |
|---|---|---|---|---|---|
| Parts by mass | | | | | |
| (1) GECO | 20 | 20 | 20 | 20 | 20 |
| (2) Solid BR | 70 | 69 | 67 | 65 | 60 |
| (3) Liquid BR Mn: 8000 | — | 1 | 3 | 5 | 10 |
| Mn: 26000 | — | — | — | — | — |
| Mn: 9000 | — | — | — | — | — |
| (4) CR | 10 | 10 | 10 | 10 | 10 |
| Evaluation | | | | | |
| Type-A hardness | 61 | 61 | 60 | 57 | 54 |
| Imaging durability | X | Δ | ○ | ○ | ◎ |

TABLE 3

| | Example 1-5 | Example 1-6 | Example 1-7 | Example 1-8 |
|---|---|---|---|---|
| Parts by mass | | | | |
| (1) GECO | 20 | 20 | 20 | 20 |
| (2) Solid BR | 50 | 40 | 30 | 20 |
| (3) Liquid BR Mn: 8000 | 20 | 30 | 40 | 50 |
| Mn: 26000 | — | — | — | — |
| Mn: 9000 | — | — | — | — |
| (4) CR | 10 | 10 | 10 | 10 |
| Evaluation | | | | |
| Type-A hardness | 51 | 45 | 42 | 39 |
| Imaging durability | ◎ | ◎ | ◎ | Δ |

TABLE 4

| | Example 1-9 | Example 1-10 | Example 1-11 | Example 1-12 |
|---|---|---|---|---|
| Parts by mass | | | | |
| (1) GECO | 20 | 20 | 20 | 20 |
| (2) Solid BR | 69 | 65 | 60 | 50 |
| (3) Liquid BR Mn: 8000 | — | — | — | — |
| Mn: 26000 | 1 | 5 | 10 | 20 |
| Mn: 9000 | — | — | — | — |
| (4) CR | 10 | 10 | 10 | 10 |
| NBR | — | — | — | — |
| Evaluation | | | | |
| Type-A hardness | 61 | 57 | 54 | 53 |
| Imaging durability | Δ | ○ | ◎ | ◎ |

TABLE 5

| | Example 1-13 | Example 1-14 | Example 1-15 | Conventional Example 2 |
|---|---|---|---|---|
| Parts by mass | | | | |
| (1) GECO | 20 | 20 | 20 | 20 |
| (2) Solid BR | 40 | 30 | 20 | — |
| (3) Liquid BR Mn: 8000 | — | — | — | — |
| Mn: 26000 | 30 | 40 | 50 | 10 |
| Mn: 9000 | — | — | — | — |
| (4) CR | 10 | 10 | 10 | 10 |
| NBR | — | — | — | 60 |
| Evaluation | | | | |
| Type-A hardness | 49 | 42 | 37 | — |
| Imaging durability | ◎ | ◎ | Δ | — |

TABLE 6

| | Example 1-16 | Example 1-17 | Example 1-18 | Example 1-19 |
|---|---|---|---|---|
| Parts by mass | | | | |
| (1) GECO | 20 | 20 | 20 | 20 |
| (2) Solid BR | 69 | 67 | 65 | 60 |
| (3) Liquid BR Mn: 8000 | — | — | — | — |
| Mn: 26000 | — | — | — | — |
| Mn: 9000 | 1 | 3 | 5 | 10 |
| (4) CR | 10 | 10 | 10 | 10 |
| Evaluation | | | | |
| Type-A hardness | 61 | 57 | 55 | 51 |
| Imaging durability | Δ | ○ | ◎ | ◎ |

TABLE 7

| | Example 1-20 | Example 1-21 | Example 1-22 | Example 1-23 |
|---|---|---|---|---|
| Parts by mass | | | | |
| (1) GECO | 20 | 20 | 20 | 20 |
| (2) Solid BR | 50 | 40 | 30 | 20 |
| (3) Liquid Mn: 8000 | — | — | — | — |
| Mn: 26000 | — | — | — | — |

TABLE 7-continued

| | | Example 1-20 | Example 1-21 | Example 1-22 | Example 1-23 |
|---|---|---|---|---|---|
| BR | Mn: 9000 | 20 | 30 | 40 | 50 |
| | (4) CR | 10 | 10 | 10 | 10 |
| | | Evaluation | | | |
| | Type-A hardness | 48 | 45 | 42 | 39 |
| | Imaging durability | ◎ | ◎ | ◎ | Δ |

The results for Examples 1-1 to 1-23 and Conventional Example 1 in Tables 2 to 7 indicate that, where the solid BR (2) and the liquid BR (3) are used in combination, the semiconductive roller is free from the linear mark and the like, and is excellent in imaging durability and substantially free from the permanent compressive deformation when being used as the developing roller.

The results for Examples 1-1 to 1-23 indicate that, for further improvement of the aforementioned effects, the proportion of the liquid BR (3) is preferably not less than 3 parts by mass and not greater than 40 parts by mass, particularly preferably not less than 5 parts by mass, based on 100 parts by mass of the overall rubber component.

Examples 1-1 to 1-8, Example 1-9 to 1-15 and Examples 1-16 to 1-23 indicate that, for further improvement of the aforementioned effects, the liquid BR (3) preferably has a number average molecular weight Mn of not less than 7500 and not greater than 10000, particularly preferably not less than 8500 and not greater than 9500.

Solid BR-Liquid SBR Based Rubber Composition

Examples 2-1 to 2-8

For the rubber component, the same GECO (1), the same solid BR (2) and the same CR (4) as used in Example 1-1 were used, and a liquid SBR (3) (KURAPRENE L-SBR-820 available from Kuraray Co., Ltd., and having a number average molecular weight Mn of 8500) was used instead of the liquid BR (3).

Rubber compositions were prepared in substantially the same manner as in Example 1-1, except that the liquid SBR (3) was used in proportions of 1 part by mass (Example 2-1), 3 parts by mass (Example 2-2), 5 parts by mass (Example 2-3), 10 parts by mass (Example 2-4), 20 parts by mass (Example 2-5), 30 parts by mass (Example 2-6), 40 parts by mass (Example 2-7) and 50 parts by mass (Example 2-8), and the proportion of the solid BR (2) was adjusted so that the total amount of the rubbers for the rubber component was 100 parts by mass. Then, semiconductive rollers were produced in substantially the same manner as in Example 1-1 by using the rubber compositions thus prepared.

The aforementioned tests were performed on the semiconductive rollers produced in Examples 2-1 to 2-8. The results are shown in Tables 8 and 9.

TABLE 8

| | Example 2-1 | Example 2-2 | Example 2-3 | Example 2-4 |
|---|---|---|---|---|
| | Parts by mass | | | |
| (1) GECO | 20 | 20 | 20 | 20 |
| (2) Solid BR | 69 | 67 | 65 | 60 |

TABLE 8-continued

| | Example 2-1 | Example 2-2 | Example 2-3 | Example 2-4 |
|---|---|---|---|---|
| (3) Liquid SBR | 1 | 3 | 5 | 10 |
| (4) CR | 10 | 10 | 10 | 10 |
| | Evaluation | | | |
| Type-A hardness | 61 | 60 | 56 | 54 |
| Imaging durability | Δ | ○ | ◎ | ◎ |

TABLE 9

| | Example 2-5 | Example 2-6 | Example 2-7 | Example 2-8 |
|---|---|---|---|---|
| | Parts by mass | | | |
| (1) GECO | 20 | 20 | 20 | 20 |
| (2) Solid BR | 50 | 40 | 30 | 20 |
| (3) Liquid SBR | 20 | 30 | 40 | 50 |
| (4) CR | 10 | 10 | 10 | 10 |
| | Evaluation | | | |
| Type-A hardness | 50 | 46 | 42 | 38 |
| Imaging durability | ◎ | ◎ | ◎ | Δ |

The results for Examples 2-1 to 2-8 shown in Tables 8 and 9 and the results for Conventional Example 1 indicate that, where the solid BR (2) and the liquid SBR (3) are used in combination, the semiconductive roller is free from the linear mark and the like (which were observed in Conventional Example 2), and is excellent in imaging durability and substantially free from the permanent compressive deformation when being used as the developing roller.

The results for Examples 2-1 to 2-8 indicate that, for further improvement of the aforementioned effects, the proportion of the liquid SBR (3) is preferably not less than 3 parts by mass and not greater than 40 parts by mass, particularly preferably not less than 5 parts by mass, based on 100 parts by mass of the overall rubber component.

Solid SBR-Liquid BR Based Rubber Composition

Example 3-1 to 3-7

For the rubber component, the same GECO (1), the same liquid BR (3) and the same CR (4) as used in Example 1-1 were used, and a solid SBR (E-SBR JSR 1502 available from JSR Co., Ltd.) was used instead of the solid BR (2).

Rubber compositions were prepared in substantially the same manner as in Example 1-1, except that the liquid BR (3) was used in proportions of 1 part by mass (Example 3-1), 3 parts by mass (Example 3-2), 5 parts by mass (Example 3-3), 10 parts by mass (Example 3-4), 20 parts by mass (Example 3-5), 30 parts by mass (Example 3-6) and 40 parts by mass (Example 3-7), and the proportion of the solid SBR (2) was adjusted so that the total amount of the rubbers for the rubber component was 100 parts by mass. Then, semiconductive rollers were produced in substantially the same manner as in Example 1-1 by using the rubber compositions thus prepared.

Conventional Example 3

A rubber composition was prepared in substantially the same manner as in Example 3-1, except that the liquid BR (3) was not blended and the proportion of the solid SBR (3) was 70 parts by mass. Then, a semiconductive roller was produced in substantially the same manner as in Example 3-1 by using the rubber composition thus prepared.

The aforementioned tests were performed on the semiconductive rollers produced in Examples 3-1 to 3-7. The results are shown in Tables 10 and 11.

TABLE 10

| | Conventional Example 3 | Example 3-1 | Example 3-2 | Example 3-3 |
|---|---|---|---|---|
| | Parts by mass | | | |
| (1) GECO | 20 | 20 | 20 | 20 |
| (2) Solid SBR | 70 | 69 | 67 | 65 |
| (3) Liquid BR | — | 1 | 3 | 5 |
| (4) CR | 10 | 10 | 10 | 10 |
| | Evaluation | | | |
| Type-A hardness | 63 | 61 | 59 | 53 |
| Imaging durability | X | Δ | ○ | ◎ |

TABLE 11

| | Example 3-4 | Example 3-5 | Example 3-6 | Example 3-7 |
|---|---|---|---|---|
| | Parts by mass | | | |
| (1) GECO | 20 | 20 | 20 | 20 |
| (2) Solid SBR | 60 | 50 | 40 | 30 |
| (3) Liquid BR | 10 | 20 | 30 | 40 |
| (4) CR | 10 | 10 | 10 | 10 |
| | Evaluation | | | |
| Type-A hardness | 49 | 42 | 41 | 38 |
| Imaging durability | ◎ | ◎ | ◎ | Δ |

The results for Examples 3-1 to 3-7 and Conventional Example 3 shown in Tables 10 and 11 indicate that, where the solid SBR (2) and the liquid BR (3) are used in combination, the semiconductive roller is free from the linear mark and the like, and is excellent in imaging durability and substantially free from the permanent compressive deformation when being used as the developing roller.

The results for Examples 3-1 to 3-7 indicate that, for further improvement of the aforementioned effects, the proportion of the liquid BR (3) is preferably not less than 3 parts by mass and not greater than 30 parts by mass, particularly preferably not less than 5 parts by mass, based on 100 parts by mass of the overall rubber component.

Solid SBR-Liquid SBR Based Rubber Composition

Examples 4-1 to 4-7

For the rubber component, the same GECO (1) and the same CR (4) as used in Example 1-1 were used. Further, a solid SBR (2) (E-SBR JSR 1502 available from JSR Co., Ltd.) was used instead of the solid BR (2), and a liquid SBR (3) (KURAPRENE L-SBR-820 available from Kuraray Co., Ltd., and having a number average molecular weight Mn of 8500) was used instead of the liquid BR (3).

Rubber compositions were prepared in substantially the same manner as in Example 1-1, except that the liquid SBR (3) was used in proportions of 1 part by mass (Example 4-1), 5 parts by mass (Example 4-2), 10 parts by mass (Example 4-3), 20 parts by mass (Example 4-4), 30 parts by mass (Example 4-5), 40 parts by mass (Example 4-6) and 50 parts by mass (Example 4-7), and the proportion of the solid SBR (2) was adjusted so that the total amount of the rubbers for the rubber component was 100 parts by mass. Then, semiconductive rollers were produced in substantially the same manner as in Example 1-1 by using the rubber compositions thus prepared.

Examples 4-8 to 4-14

Rubber compositions were prepared in substantially the same manner as in Example 1-1, except that KURAPRENE L-SBR-841 available from Kuraray Co., Ltd. (having a number average molecular weight Mn of 10000) was used as a liquid SBR (3) in proportions of 1 part by mass (Example 4-8), 5 parts by mass (Example 4-9), 10 parts by mass (Example 4-10), 20 parts by mass (Example 4-11), 30 parts by mass (Example 4-12), 40 parts by mass (Example 4-13) and 50 parts by mass (Example 4-14), and the proportion of the solid SBR (2) was adjusted so that the total amount of the rubbers for the rubber component was 100 parts by mass. Then, semiconductive rollers were produced in substantially the same manner as in Example 1-1 by using the rubber compositions thus prepared.

The aforementioned tests were performed on the semiconductive rollers produced in Examples 4-1 to 4-14. The results are shown in Tables 12 to 15.

TABLE 12

| | Example 4-1 | Example 4-2 | Example 4-3 | Example 4-4 |
|---|---|---|---|---|
| | Parts by mass | | | |
| (1) GECO | 20 | 20 | 20 | 20 |
| (2) Solid SBR | 69 | 65 | 60 | 50 |
| (3) Liquid SBR Mn: 8500 | 1 | 5 | 10 | 20 |
| (3) Liquid SBR Mn: 10000 | — | — | — | — |
| (4) CR | 10 | 10 | 10 | 10 |
| | Evaluation | | | |
| Type-A hardness | 61 | 59 | 51 | 52 |
| Imaging durability | Δ | ○ | ◎ | ◎ |

TABLE 13

| | Example 4-5 | Example 4-6 | Example 4-7 |
|---|---|---|---|
| | Parts by mass | | |
| (1) GECO | 20 | 20 | 20 |
| (2) Solid SBR | 40 | 30 | 20 |
| (3) Liquid SBR Mn: 8500 | 30 | 40 | 50 |
| (3) Liquid SBR Mn: 10000 | — | — | — |
| (4) CR | 10 | 10 | 10 |
| | Evaluation | | |
| Type-A hardness | 48 | 45 | 38 |
| Imaging durability | ◎ | ◎ | Δ |

TABLE 14

| | Example 4-8 | Example 4-9 | Example 4-10 | Example 4-11 |
|---|---|---|---|---|
| | Parts by mass | | | |
| (1) GECO | 20 | 20 | 20 | 20 |
| (2) Solid SBR | 69 | 65 | 60 | 50 |

TABLE 14-continued

| | | Example 4-8 | Example 4-9 | Example 4-10 | Example 4-11 |
|---|---|---|---|---|---|
| (3) Liquid SBR | Mn: 8500 | — | — | — | — |
| | Mn: 10000 | 1 | 5 | 10 | 20 |
| (4) CR | | 10 | 10 | 10 | 10 |
| NBR | | — | — | — | — |
| Evaluation | | | | | |
| Type-A hardness | | 61 | 59 | 57 | 54 |
| Imaging durability | | Δ | ○ | ○ | ◎ |

TABLE 15

| | | Example 4-12 | Example 4-13 | Example 4-14 |
|---|---|---|---|---|
| Parts by mass | | | | |
| (1) GECO | | 20 | 20 | 20 |
| (2) Solid SBR | | 40 | 30 | 20 |
| (3) Liquid SBR | Mn: 8500 | — | — | — |
| | Mn: 10000 | 30 | 40 | 50 |
| (4) CR | | 10 | 10 | 10 |
| NBR | | — | — | — |
| Evaluation | | | | |
| Type-A hardness | | 48 | 46 | 40 |
| Imaging durability | | ◎ | ◎ | Δ |

The results for Examples 4-1 to 4-14 shown in Tables 12 to 15 and the results for Conventional Example 3 indicate that, where the solid SBR (2) and the liquid SBR (3) are used in combination, the semiconductive roller is free from the linear mark and the like (which were observed in Conventional Example 2), and is excellent in imaging durability and substantially free from the permanent compressive deformation when being used as the developing roller.

The results for Examples 4-1 to 4-14 indicate that, for further improvement of the aforementioned effects, the proportion of the liquid SBR (3) is preferably not less than 5 parts by mass and not greater than 40 parts by mass, particularly preferably not less than 10 parts by mass, based on 100 parts by mass of the overall rubber component.

Examples 4-1 to 4-7 and Examples 4-8 to 4-14 indicate that, for further improvement of the aforementioned effects, the liquid SBR (3) preferably has a number average molecular weight Mn of not less than 8000 and not greater than 10000, particularly preferably not greater than 9000.

This application corresponds to Japanese Patent Application No. 2015-077939 filed in the Japan Patent Office on Apr. 6, 2015, the disclosure of which is incorporated herein by reference in its entirety.

What is claimed is:

1. A semiconductive roller comprising a tubular body formed from a rubber composition which comprises a rubber component and a crosslinking component for crosslinking the rubber component, the rubber component comprising:

(1) an epichlorohydrin rubber;

(2) at least one solid rubber selected from the group consisting of a solid butadiene rubber and a solid styrene butadiene rubber; and (3) at least one liquid rubber selected from the group consisting of a liquid butadiene rubber and a liquid styrene butadiene rubber.

2. The semiconductive roller according to claim 1, wherein the solid rubber (2) is the solid butadiene rubber, and the liquid rubber (3) is the liquid butadiene rubber;

wherein the liquid butadiene rubber is present in a proportion of not less than 3 parts by mass and not greater than 40 parts by mass based on 100 parts by mass of the overall rubber component in the rubber composition.

3. The semiconductive roller according to claim 2, further comprising an oxide film provided in an outer peripheral surface of the tubular body thereof.

4. The semiconductive roller according to claim 1, wherein the solid rubber (2) is the solid butadiene rubber, and the liquid rubber (3) is the liquid styrene butadiene rubber;

wherein the liquid styrene butadiene rubber is present in a proportion of not less than 3 parts by mass and not greater than 40 parts by mass based on 100 parts by mass of the overall rubber component in the rubber composition.

5. The semiconductive roller according to claim 4, further comprising an oxide film provided in an outer peripheral surface of the tubular body thereof.

6. The semiconductive roller according to claim 1, wherein the solid rubber (2) is the solid styrene butadiene rubber, and the liquid rubber (3) is the liquid butadiene rubber;

wherein the liquid butadiene rubber is present in a proportion of not less than 3 parts by mass and not greater than 30 parts by mass based on 100 parts by mass of the overall rubber component in the rubber composition.

7. The semiconductive roller according to claim 6, further comprising an oxide film provided in an outer peripheral surface of the tubular body thereof.

8. The semiconductive roller according to claim 1, wherein the solid rubber (2) is the solid styrene butadiene rubber, and the liquid rubber (3) is the liquid styrene butadiene rubber;

wherein the liquid styrene butadiene rubber is present in a proportion of not less than 5 parts by mass and not greater than 40 parts by mass based on 100 parts by mass of the overall rubber component in the rubber composition.

9. The semiconductive roller according to claim 8, further comprising an oxide film provided in an outer peripheral surface of the tubular body thereof.

10. The semiconductive roller according to claim 1, further comprising an oxide film provided in an outer peripheral surface of the tubular body thereof.

11. An electrophotographic image forming apparatus which incorporates the semiconductive roller according to claim 1 as a developing roller.

* * * * *